United States Patent [19]

Stutz et al.

[11] 4,445,993

[45] May 1, 1984

[54] LASER PERFORATED PLATING BARREL AND METHOD OF CONSTRUCTING THE SAME

[75] Inventors: P. David Stutz, Burr Ridge; George J. Kuchta, Stickney, both of Ill.

[73] Assignee: Stutz Company, Chicago, Ill.

[21] Appl. No.: 316,081

[22] Filed: Oct. 29, 1981

[51] Int. Cl.[3] ..... C25D 17/20

[52] U.S. Cl. ..... 204/213; 264/25; 264/154

[58] Field of Search ..... 204/213; 264/154, 25

[56] References Cited

U.S. PATENT DOCUMENTS

| | | | |
|---|---|---|---|
| 2,243,728 | 5/1941 | Davis | 204/213 |
| 3,337,442 | 8/1967 | Kiefer et al. | 204/213 |
| 3,549,858 | 12/1970 | Larive | 264/154 X |
| 3,563,877 | 9/1967 | Carmichael | 204/213 |
| 3,582,526 | 12/1967 | Campana | 204/213 |
| 3,594,261 | 7/1971 | Broerman | 264/154 X |
| 3,668,028 | 6/1972 | Short | 264/154 X |
| 4,015,831 | 4/1977 | Petzold | 204/213 X |

*Primary Examiner*—G. L. Kaplan
*Assistant Examiner*—Nam X. Nguyen

[57] ABSTRACT

A single, thin walled corrugated electroplating barrel provided with laser formed extremely small perforations, designed and arranged so as to be suitable for handling bulk quantities of minute parts, with perforations performing a pumping action for constant agitation of the plating solution during plating operations.

2 Claims, 8 Drawing Figures

LASER PERFORATED PLATING BARREL AND METHOD OF CONSTRUCTING THE SAME

SUMMARY OF THE INVENTION

This invention relates to improvements in electroplating barrels especially suitable for handling bulk quantities of small parts such as electronic components, minute screws, etc.

The conventional plating barrel has perforations formed by drilling, cutting, or molding, and whose size depends on the size of the parts to be plated.

A limitation on such prior barrels is the small perforations through thick wall material offers excessive resistance to solution flow due to burrs, the length of travel and capillarity. To form a conventional barrel with thousands of small round perforations is not only expensive but such designs tend to weaken the wall of the barrel, resulting in cracks and splits.

A number of ideas were put forth to overcome these problems, such as that described in U.S. Pat. No. 3,472,753. In such prior attempt, the barrel was constructed with a generally rigid open grid structure, having encapsulated or bonded to its inner wall a thin, open mesh fabric. These barrels have been found to be short lived, as the fine, plastic mesh was soon torn and penetrated by the points, edges, and hooks of the parts being plated. The soft plastic mesh wearing and clogging shut with the plating salts, resulting in downtime and cost of replacement panels and cylinders. In addition, the exterior grid structure produced retaining pockets which scoop up plating solution which was carried over into the next solution. This is an obsolete construction in view of today's pollution problems and high precious metal costs.

Another idea was described in U.S. Pat. No. 3,582,523, which disclosed the use of a removable one piece plastic insert provided with small perforations. Such structure was unacceptable as it interfered with proper drainage of the solution, and therefore adversely affected the plating action.

An object of the present invention is to provide a plating barrel with thin corrugated walls having small minute perforations particularly useful in the plating of small parts.

Another object of this invention is to provide a plating barrel with a solid one piece thin sidewall, with specifically designed perforations which overcome the problems of capillarity.

Another object of this invention is to provide a plating barrel which will carry over as little solution as possible as it passes from one solution to the next, yet will create a pumping action that will result in a constant agitation of the solution during plating operations.

A further object of this invention is to provide a plating barrel with openings that are extremely clean and which will not readily clog with plating salts.

Still another object of this invention is to provide an electroplating barrel which is simple in construction, long-lived and highly efficient in electroplating.

BRIEF DESCRIPTION OF THE DRAWINGS

The invention will be best understood by reference to the accompanying drawings showing the preferred form of construction by which the objects of the invention are achieved, and in which.

DESCRIPTION OF THE INVENTION

Figure 1:
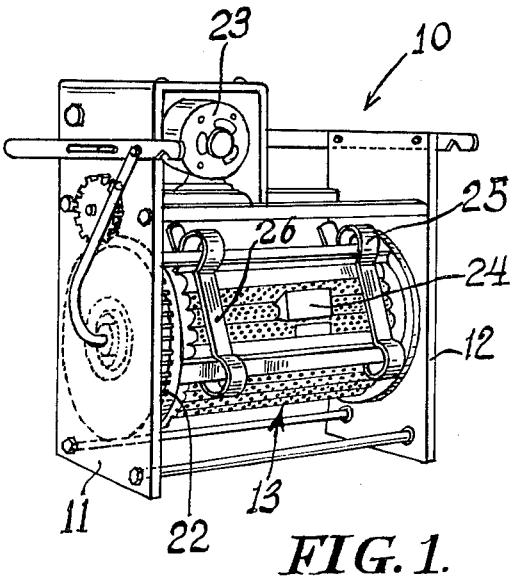
FIG. 1 is a perspective view of a plating apparatus including the invention.
Figure 2:
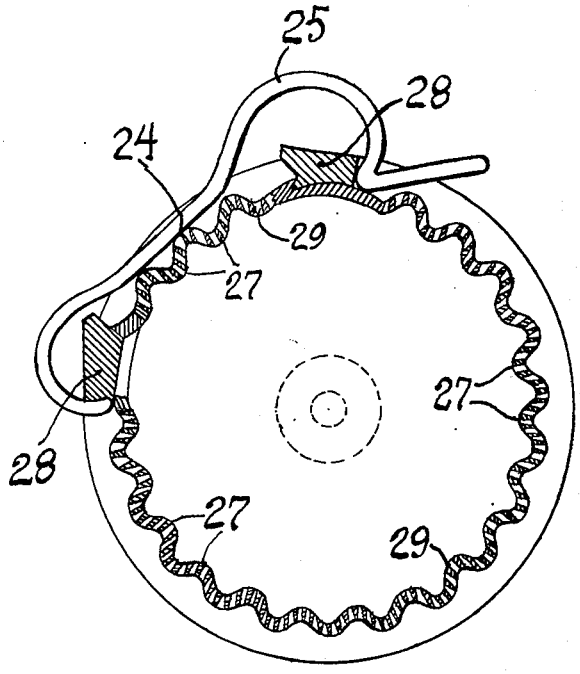
FIG. 2 is a sectional detailed view of the plating barrel of this invention.

The several objects of this invention accomplished by the preferred form of construction shown in the accompanying drawings wherein the improved plating apparatus is indicated generally at 10. Such apparatus includes side plates 11 and 12 that support therebetween the plating barrel 13.

The plating barrel 13 is provided with end wall 14 and 15, and the confronting wall surfaces of these end walls are each formed to provide a serpentine-like groove 16 which are adapted to receive the like formed edges of the cylinderical side wall 17 of the barrel 13.

The end walls 14 and 15 of the barrel 13 have bearing sleeves 18 and 19 secured thereto. These bearing sleeves 14 and 15 project into bearing openings 20 fromed in the side plates 11 and 12 and rotatably support the barrel 13.

Secured in any suitable manner to the end wall 14 of the barrel 13 is a gear 21, which operatively meshes with a driving gear 22 driven by a suitable electric motor 23, in a manner well known in the art.

The cylinderical corrugated wall 17 of the barrel 13 is provided with an opening normally closed by a removable door 24. This door is latched into closed position by suitable latch bars 25 and 26, as shown in FIG. 1. This door 24 is also corrugated so that it together with the cylinderical wall 17 of the barrel provide uninterrupted horizontally extending internal tumbling ribs 27.

The entire surface area of the door 24 as well as that of the side wall 17 of the barrel 13, with the exception of the latching heads 28, is perforated as at 29 to permit the flow of solution into, through and out of the barrel 13 when the same is submerged and rotated in the fluid contained within the plating tank, not shown.

The plating barrel and its components, as above described and illustrated are recognized as standard in the art, and are shown, described and explained in U.S. Pat. No. 3,337,442, dated Aug. 22, 1967, The present invention is in the construction of the cylindrical corrugated perforated side wall 17 of the barrel 13.

As shown schematically in the drawings, the perforations 29 extend in diverging directions with respect to each other outwardly radially from the axis of the barrel 13.

Figure 5:
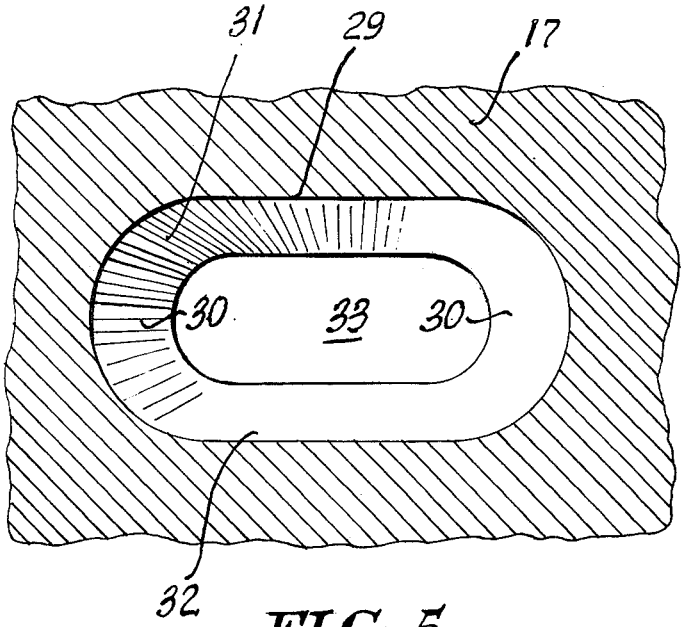
FIG. 5 is an enlarged fragmentary front elevational view of one opening formed in the barrel.
Figure 6:
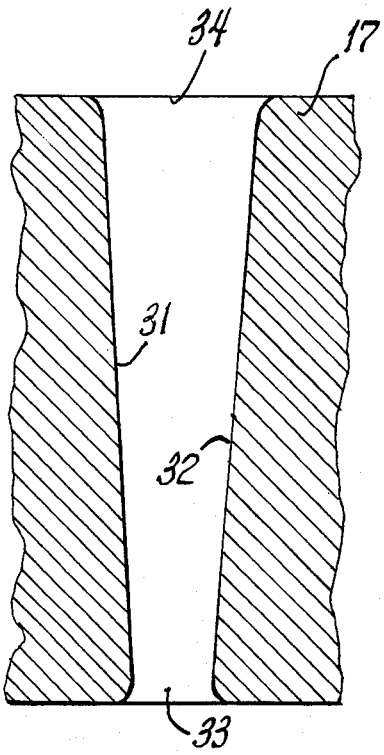
FIG. 6 is an enlarged fragmentary side view of the opening of FIG. 5.
Figure 7:
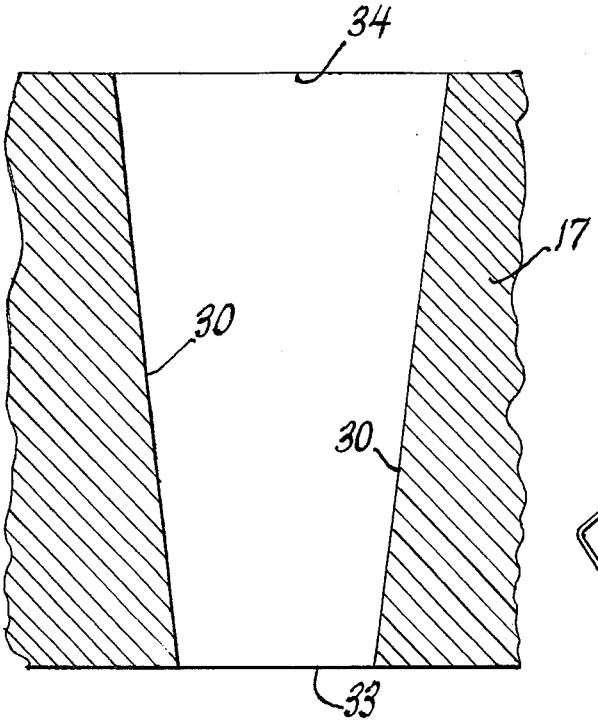
FIG. 7 is an enlarged fragmentary plan view of the opening of FIG. 5.

As seen in FIGS. 5,6 and 7 these perforations 29, are actually short slots, on staggered centers. The perforations are designed to have tapered sides 30, as well as tapered top and bottom walls 31 and 32, terminating at their inner ends in reduced openings 33. The small inner opening 33 prevents parts being plated from projecting therein. The outer large openings 34 permits reduced resistance to solution evacuation.

By such an arrangement and formation, when the barrel 13 is rotated in the solution, the diverging perforation 29 will in effect cause self-pumping of the solution into and from the barrel 13, thus causing a continous flowing action of the solution which thoroughly mixes the same within as well as without the barrel, with the result that a more efficient plating operation is accomplished.

In accordance with this invention the perforations 29 as indicated are created by contacting the wall 17 with a focused coherent light energy such as a gas laser beam.

This is done economically by pulsing the laser while continously rotating the barrel. When focused correctly the laser can produce the size perforation or openings 29 desired. The material removed is vaporized and the resulting hole is extremely clean. It is also noted that the effect of the laser in heating the material to form the perforations actually forms a strengthened ring (annealed) around each opening. This annealling process permits the thickness of the wall 17 to be reduced to ⅛ inch or less.

It has been determined that the following perforation pattern works best:

Inside—0.015" wide×0.045" long

Outside—0.025" wide×0.055" long with the perforations staggered on 0.080" centers. Generally the plurality of perforations through the barrel sidewall must result in from 15% to 30% open area on the interior face. Less than 15% open area has been found not to allow sufficient solution circulation for plating. More than 30% open area on the interior wall face can result in sidewall weakness, since the size of the perforations get larger toward the exterior side.

Figure 3:
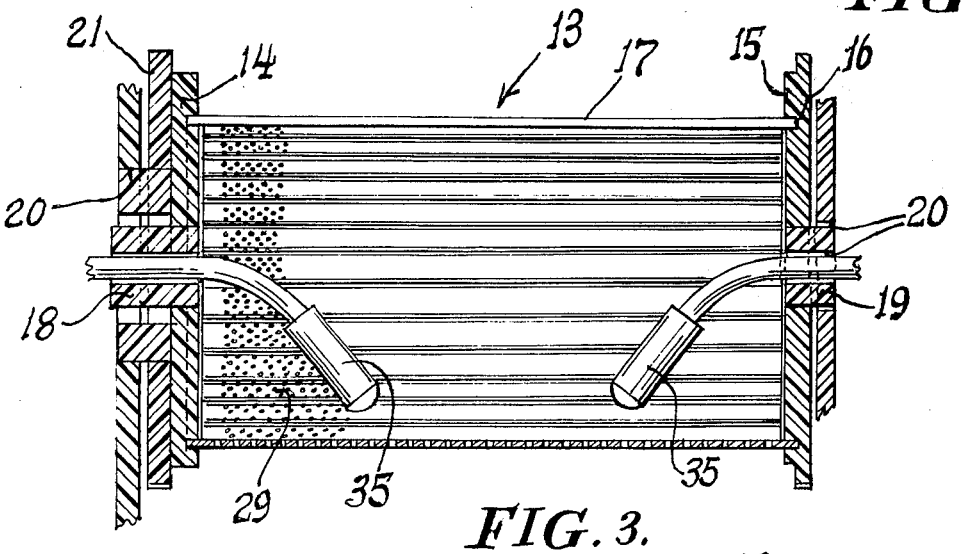
FIG. 3 is a sectional detailed view of the barrel and its relation to the apparatus.
Figure 4:
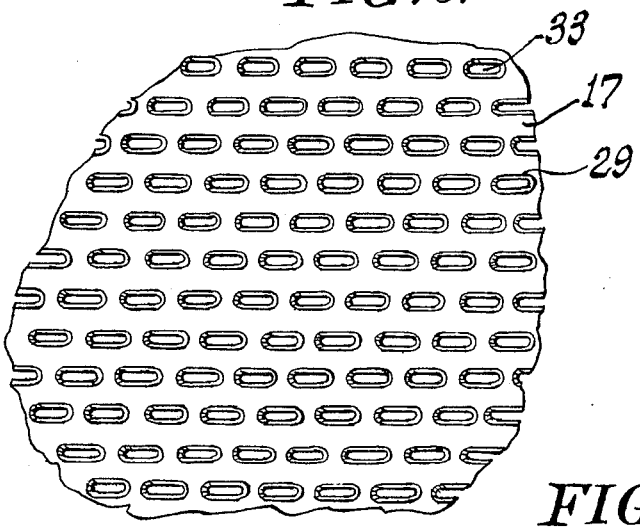
FIG. 4 is a fragmentary side elevational view of the cylindrical wall of the barrel shown in FIG. 1.

As shown in FIG. 3, there are projected through the bearing sleeves 18 and 19 the usual electrodes 35 which may be adjusted with respect to each other for the most efficient plating operation.

In use, a number of workpieces to be plated are confined in the barrel 13, being placed therein through the door opening. The barrel 13 is then submerged in a solution contained in a tank such as that shown in U.S. Pat. No. 2,673,076 dated Mar. 23, 1954. Through the operation of the motor 23, the barrel 13 is caused to rotate. In actual practice, we have found that as the barrel 13 rotates, the workpieces will follow the direction of rotation of the barrel and will not be bounced therein or caused to drop to the bottom as would result in the case where the barrel is formed hexagonally in cross section and provided with substantially spaced apart tumbling ribs.

We have also found by actual experience that by the unique formation of the perforations 29 in the cylindrical wall 17 of the barrel 13 as well as in the door 24, the solution is pumped into the barrel 13 as it is rotated and is also ejected therefrom, thus resulting in a constant agitation of the solution and a continuous supply of the same within the barrel 13. This continuous supply of solution in the barrel 13 results in a more efficient plating operation.

By forming corrugations in the side wall 17 of the barrel 13 in the direction of its long axis, the barrel is strengthened so as to restrain the deflection of the workpieces under the separating stresses imposed thereon by the weight and tumbling action of such workpieces.

It is intended that the barrel 13 be formed of such material as will best serve the purpose, and in this connection it is suggested that the material be formed of high tensil strength plastic, which we have found to be the best material for continuous processing of workpieces through the operation of electrolytic cleaning, rinsing, acid treatment, and plating. When formed of such material, the weight of the plating barrel 13 is also reduced to a minimum.

It is preferably intended that the sheet making up the side wall 17 of the barrel 13 be a flat sheet which is corrugated cylindrically form molded, after which the corrugations are laser drilled so that each provides a plurality of perforations 29 as illustrated, with the perforations 29 of each corrugation diverging outwardly with respect to each other radially from the long axis of the barrel.

Figure 8:
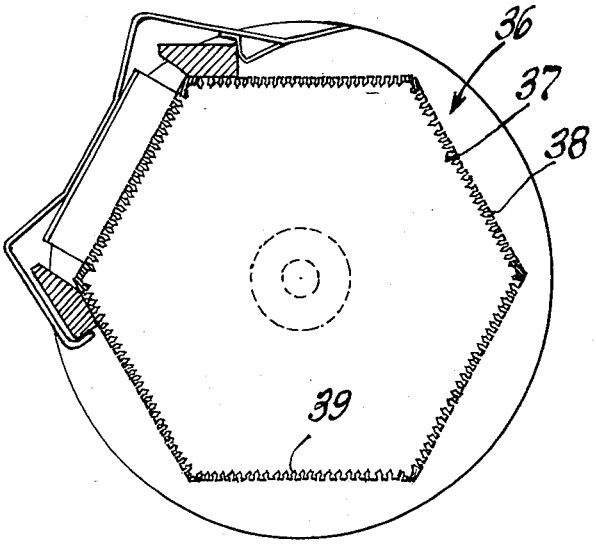
FIG. 8 is a side sectional view of a modified form of the plating barrel of this invention.

FIG. 8 shows a modified construction for the barrel. In such illustration the barrel 36 is hexagonally shaped, and its wall sections 37 are provided with perforations 38 of the same size and configuration as perforations 29 shown in the preferred embodiment. However barrel 36 is provided on the inner wall surfaces of the walls with prisms, ridges or ribs 39, which aid in the tumbling action of the parts being plated.

A plating barrel constructed in accordance with our invention herein described, will be capable of accomplishing the several salient objects of our invention. We have found by actual experience that the same is highly efficient in use and economical in manufacture.

While we have illustrated and described the preferred form of construction for carrying our invention into effect, This is capable of variations and modifications without departing from the spirit of the invention. We therefore do not wish to be limited to the precise details of construction set forth, but desire to avail ourselves of such variations and modifications as come within the scope of the appended claims.

Having thus described our invention, what we claim as new and desire to protect by Letters Patent is:

1. An electro-plating barrel comprising:

(a) a thin continuous corrugated wall formed from a chemically inert high-tensile strength plastic having a thickness of less than 0.1875 of an inch, (b) a multiplicity of laser-formed perforations formed therein with said perforations arranged in longitudinal lines parallel to said corrugations with each line horizontally staggered with respect to each other, (c) each laser-formed perforation includes a slot-like oblong shaped opening formed on the exterior wall surface of said corrugations extending longitudinally thereof with the walls of said openings tapered inwardly to form a reduced oblong oppening on the interior wall surface of said corrugations resulting in a perforated area of not less than 15% and no greater than 30% of the total interior wall surface of the barrel.

2. A method of constructing an electroplating barrel consisting in the steps of moulding a flat thin sheet of plastic material having a thickness in the range of 0.080 inches to 0.1875 inches into a cylindrical corrugated surface, contacting the cylindrical surface with a focused coherent light energy laser beam to perforate the surface, moving and rotating the cylindrical surface in front of the beam to form rows of perforations, with the surface of the sheet around each perforation annealed by the beam, with each perforation having its walls tapered inwardly of the barrel so as to provide a large open area on the exterior surface of the barrel and a reduced open area on the interior wall surface in the range of 15% to 30% of the total wall surface.

* * * * *